United States Patent [19]

Kirsch

[11] 4,094,508

[45] June 13, 1978

[54] COMBINATION PIPE AND GAME DEVICE

[76] Inventor: Daniel D. Kirsch, 4734 N. 79th Ave., Phoenix, Ariz. 85033

[21] Appl. No.: 688,581

[22] Filed: May 21, 1976

[51] Int. Cl.[2] ..... A63F 7/00; A24F 3/00; A24F 1/16; A63H 33/28

[52] U.S. Cl. ..... 273/118 R; 46/7; 46/44; 131/178; 131/179; 131/217; 272/99; 128/2.08

[58] Field of Search ..... 273/118 R, 119 B, 95 C; 131/178, 179, 170 R, 173, 217; 46/6, 7, 44; 272/99; 128/2.08

[56] References Cited

U.S. PATENT DOCUMENTS

| | | | |
|---|---|---|---|
| 951,801 | 3/1910 | Chevers | 131/178 |
| 1,241,462 | 9/1917 | Baechtel | 131/217 X |
| 3,918,464 | 11/1975 | Kolodziej | 131/179 X |

FOREIGN PATENT DOCUMENTS

| | | | |
|---|---|---|---|
| 21,680 of | 1900 | United Kingdom | 131/178 |

*Primary Examiner*—Anton O. Oechsle
*Attorney, Agent, or Firm*—Gregory J. Nelson

[57] ABSTRACT

A combination pipe and game is disclosed. The pipe includes a base on which is mounted a transparent tube which may be in an aesthetically pleasing coiled shape. A mouth piece is attached to the ends of the tube. A pipe bowl is positioned along the tube and is in communication with the interior of the tube. A lightweight ball can move about within the tube. The object of the game is for the smoker to draw smoke through the tube advancing the ball to a predetermined position within the tube. In another embodiment, the device is adapted for use by two or more smokers by expedient of inserting a fitting having an appropriate number of outlets, smoking tubes being connectable to each of the outlets.

5 Claims, 15 Drawing Figures

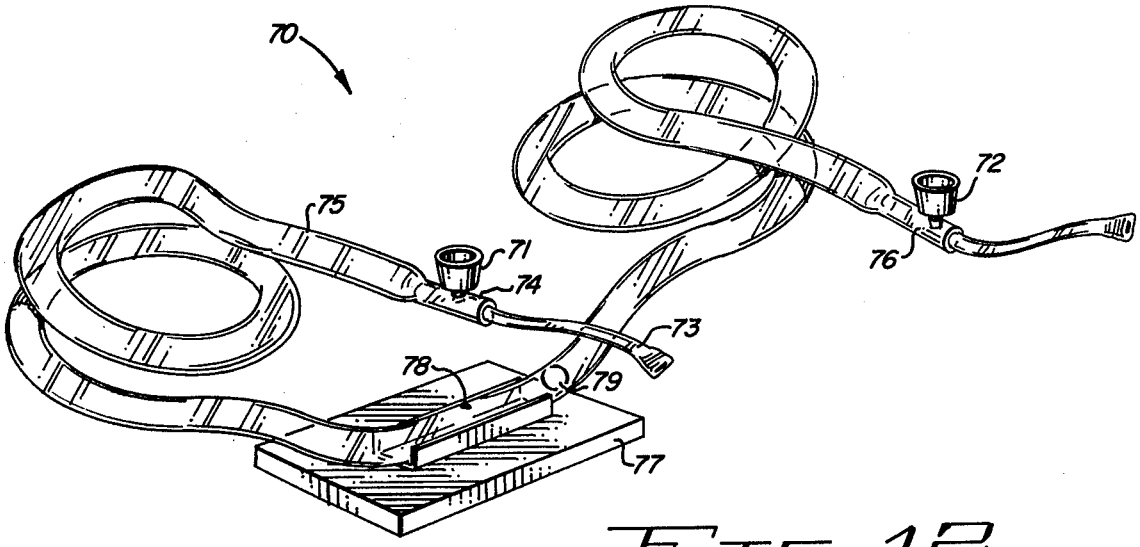
FIG-12
FIG-13
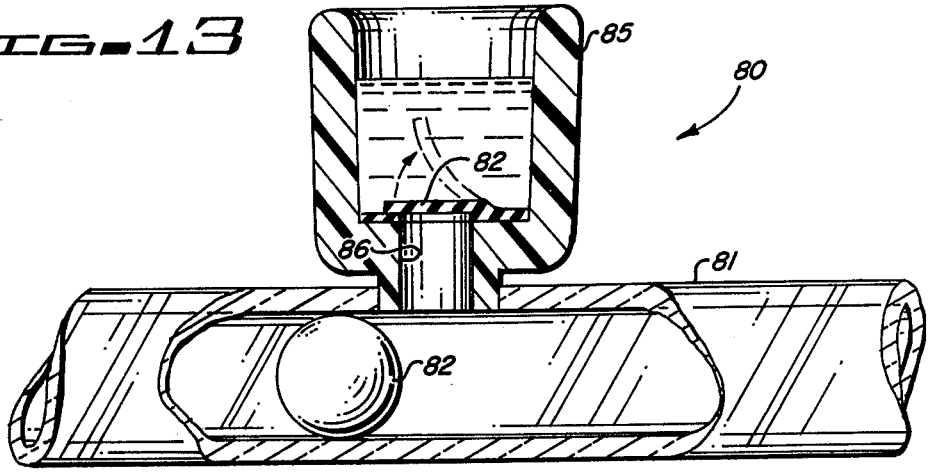
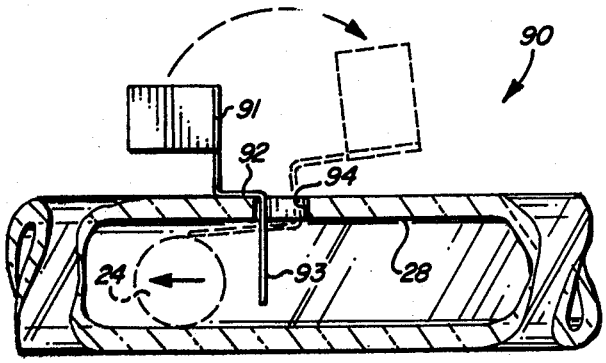
FIG-14
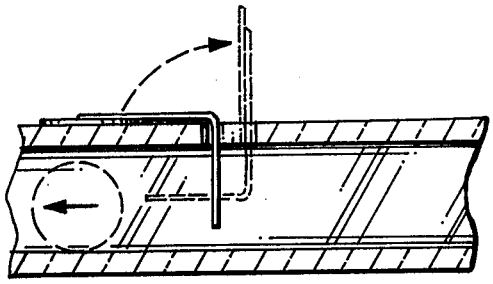
FIG-15

COMBINATION PIPE AND GAME DEVICE

The present invention relates to a pipe and more particularly relates to a combination pipe and game.

There are a number of various configurations for pipes of various types of smoking tobacco. However, none of the prior art design pipes provide a tobacco smoking device which incorporates a game so that the smoker has the increased oral and visual satisfaction of a game.

Briefly, the present invention comprehends a smoking pipe which includes a base which supports a tube, preferably transparent and flexible. A pipe bowl is in communication with the interior of the tube. The tube may have two or more ends depending on the number of smokers and may centrally connect at the base to an appropriate fitting. A removable mouth piece connects to the ends of each of the smoking tubes. Each of the smoking tubes has a basket or predetermined location along its length which is regarded as "home". A lightweight ball can move or roll freely about within the smoke tubes. The object of the game is for the smoker to draw smoke through the bowl and the respective smoke tubes and mouth pieces in such a manner as to advance the ball to the "home" location in the appropriate smoke tube. The smoker achieving this wins the game. In other embodiments the device is adapted to be used as a child's toy with the bowl containing an appropriate soap solution which is prevented from entering the tube assembly by a check valve. As the player blows the ball is advanced into the opponents tube and bubbles are created.

These and other objects and advantages of the present invention will become more apparent from the following description, claims and drawings in which:

FIG. 12 is a perspective view showing still another embodiment of the pipe of the present invention;

FIG. 13 is a partial detail view illustrating a form of the present invention to be used as a child's toy; and FIGS. 14 and 15 show a flag assembly which may be incorporated into the invention as a winner indication.

Figure 1:
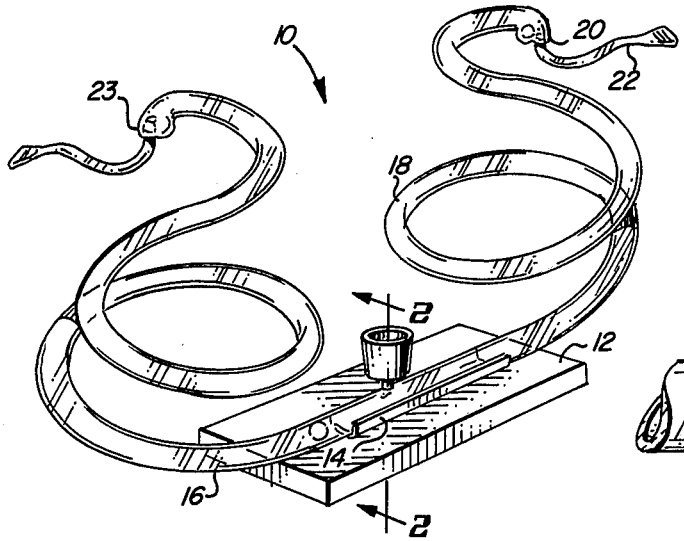
FIG. 1 is a perspective view of a preferred embodiment of the device of the present invention.
Figure 2:
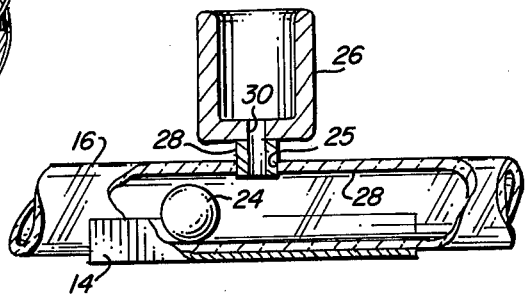
FIG. 2 is a partial sectional view taken along line 2—2 of FIG. 1.
Figure 3:
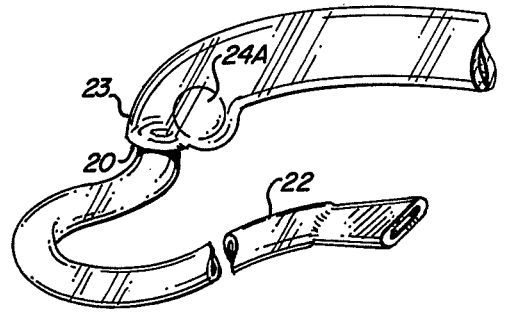
FIG. 3 is a detail perspective view of the end portion of a smoke tube and attached stem or mouth piece.

Referring now to the drawings particularly FIGS. 1 – 3, the pipe of the present invention is generally designated by the numeral 10. The pipe of the present invention includes a base member 12 which is generally rectangular and may be constructed of any suitable material such as wood or plastic. An elongate channel member 14 is fixed to the upper surface of base member 12. A continuous tube 16, preferably of transparent, heat-resistant plastic, is secured in channel 14 and oppositely extends from channel 14 having coils 18 and 19 and terminating at opposite ends 20 and 23. The tube 16 may be in any aesthetically pleasing shape and the ends 20 and 23 may be slightly enlarged or formed with a depression which is "home" for purposes of establishing a winner. A mouth piece or stem 22 is inserted at ends 20 and 23 of the smoking tube. The smoking tube 16 is provided with an aperture 25 at its approximate mid point location. An appropriate bowl 26 for the reception of tobacco material having projection 28 is inserted within aperture 25. A passage 30 communicates the interior of bowl 26 with the interior 28 of tube 16. A lightweight ball other movable member 24 is positioned within the tube 16 and is free to roll or move within the tube in response to air flow.

With the device assembled as shown in FIGS. 1 and 2, the tobacco bowl 26 is packed with suitable tobacco and tamped. The players each assume a position at opposite sides of the device 10 placing the mouth piece 22 within their respective mouths. The pipe is lit and the two players begin sucking or drawing smoke from the pipe bowl 26 into the tube interior 28. The smoke enters smoke tube 16 and is drawn to the smoker's mouth. The smoker creating the greatest suction will also cause the ball 24 to advance in his tube, the advancing position of the ball 24 being visible and following the circuitous path of the tube 16. The player to first advance the ball to the "home" position immediately adjacent the end of the smoke tube 20 or 23 nearest him wins the game. FIG. 3 illustrates the smoke tube and mouth piece in better detail with the ball 24 in the "home" position the ball will assume when the game is won.

Figure 4:
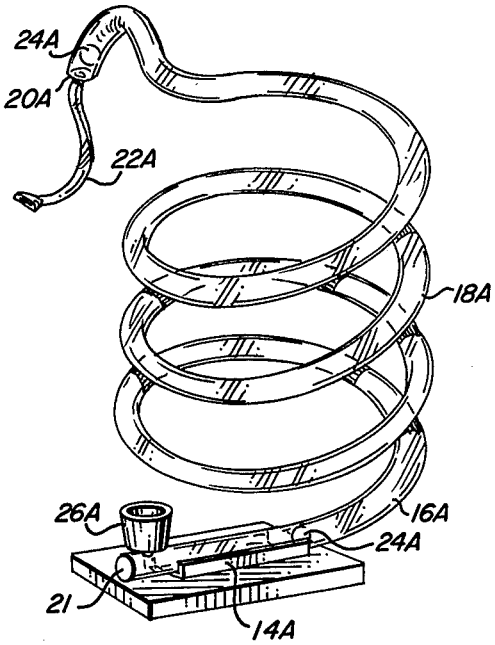
FIG. 4 is a perspective view of another form of the present invention.

FIG. 4 illustrates another form of the present invention for use by a single player. Throughout this view and the various other views, similar numbers are used to identify the same or similar elements having a letter appendant to distinguish the features in the various views. In FIG. 4, the device is provided with a base 12A on which is mounted channel 14A. Smoke tube 16 is secured by adhesive or other method to channel 14A and is provided with one or more coils 18A. Smoke tube 16A terminates at its upper end at 20A receiving a stem or mouth piece 22A. The lower end of the smoke tube is closed at 21. A pipe bowl 26A is positioned near the terminal end 21 of smoke tube 16A and is in communication with the interior of the smoke tube by an interior passage not shown. A lightweight ball 24A can freely move about within the interior of smoke tube 16A. As a smoker puffs on the pipe at the mouth piece the ball 24A is caused to advance upwardly through the smoke tube 18A until it assumes the position shown in FIG. 4. If the smoker is unable to exert a continuous draw of the pipe, the ball will be released and caused to by gravity roll downwardly to the bottom in a position along channel 14A within the tube.

Figure 5:
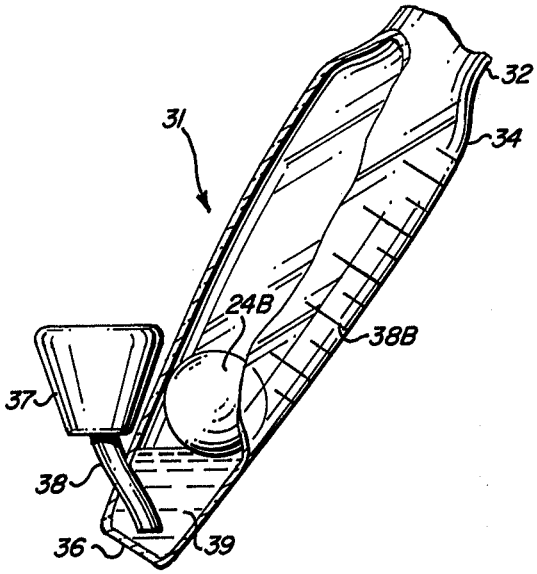
FIG. 5 is a view illustrating another form of bowl and smoke tube assembly which may be used with the present invention.

FIG. 5 shows another form of bowl assembly 31 which can be used with the present invention. For example, the bowl assembly 31 shown in FIG. 5, can be substituted and used with the smoke tube 16A shown in FIG. 4. For example, smoke tube 16A would connect to the upper neck 32 of the bowl assembly 31. The neck 32 enlarges to the maximum width at location 34 and then gradually tapers to terminal end 36 forming the end of the smoke tube. Several graduations 38 are provided along the tube. A bowl 37 for reception of tobacco is connected to the lower end of the tube by means of fitting 38. A small reservoir of water or liquid 39 may be provided in the bottom. A ball 24B, is movably housed within the assembly 31.

Figure 6:
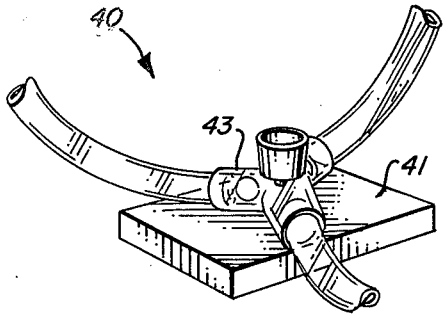
FIG. 6 is a partial perspective view of another form of the present invention.
Figure 7:
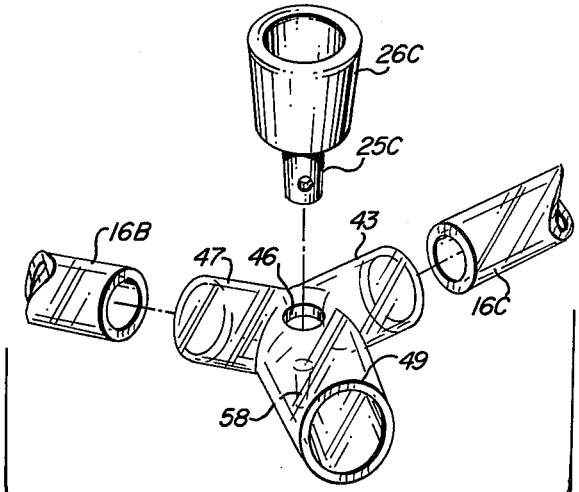
FIG. 7 is an enlarged, detail prespective view showing the components of the embodiment shown in FIG. 6.

FIGS. 6 – 9 show another form of the invention wherein the pipe of the present invention can be adapted for use for two or more smokers in accordance with the number of players. Again, this embodiment is generally designated by the numeral 40 and includes a base 41 having a central aperture or hole 42. As seen in FIG. 6, a central fitting 43 has three outlet tubes 47 spaced approximately 120° apart. The fitting is provided with a central opening or aperture 46. A pipe bowl 26C is engageable in aperture 46 in base 41 by insertion of appropriate projection 49 within the aperture 46. Three smoke tubes 16C may be inserted or engaged within each of the outlets 47 of the fitting 43. Thus, with the configuration shown in FIGS. 6 and 7, three players can participate in the game and use the pipe.

Figure 8:
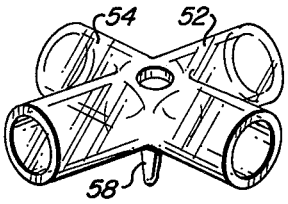
FIG. 8 is a perspective view illustrating another form of fitting which may be used with the embodiment shown in FIG. 6.

FIG. 8 shows another form of fitting generally designated by the numeral 52 having four outlets 54 for connection to smoke tubes. A projection 55 is engageable in the aperture of base 41 and with use of fitting 52 four players may engage in the game.

Figure 9:
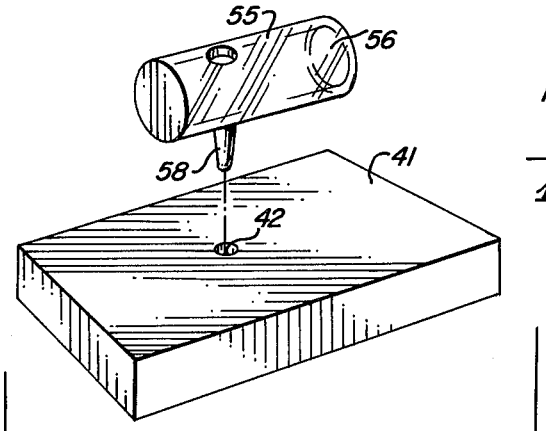
FIG. 9 illustrates still another form of the fitting which may be used with the invention shown in FIG. 6.

Similarly, FIG. 9 shows a form of the invention in which the fitting 55 has two oppositely disposed outlets 56 for connection to smoke tubes. Again, a projection 58 is insertable in aperture 42 and base 41 to assemble the device.

Figure 10:
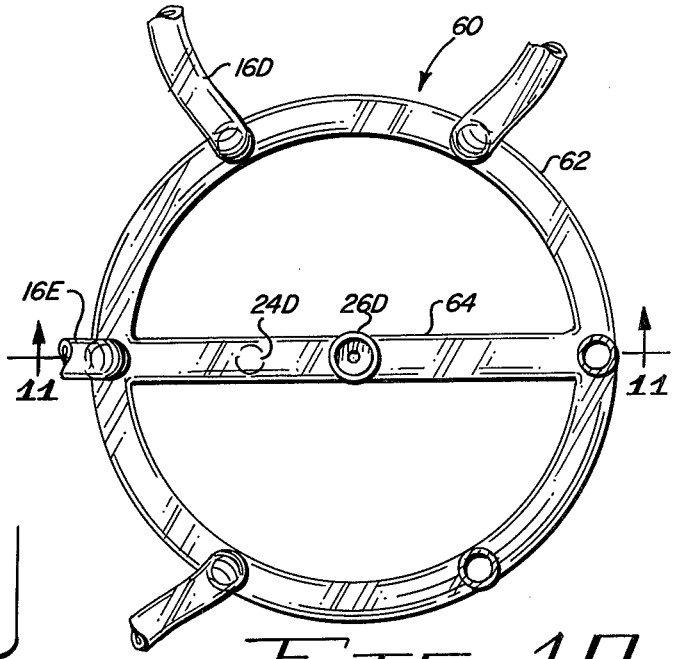
FIG. 10 is a top view of another embodiment of the pipe of the present invention.
Figure 11:
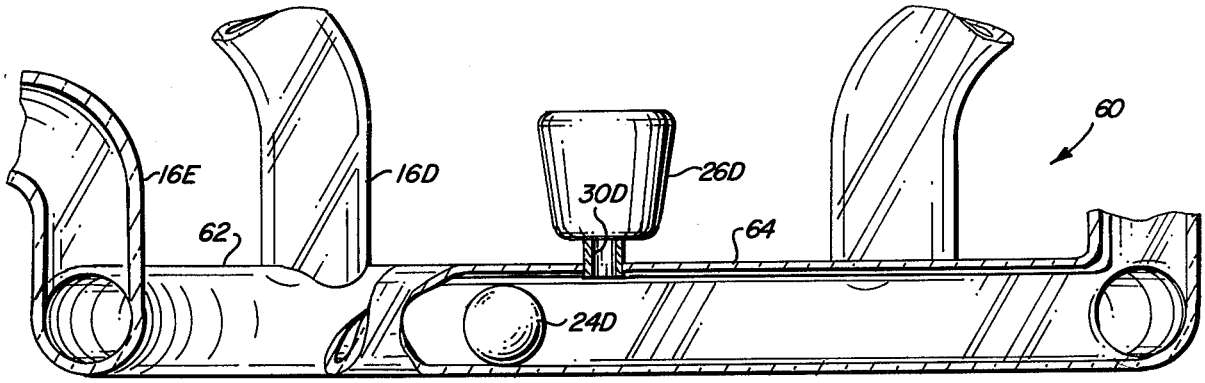
FIG. 11 is a sectional view taken along lines 11—11 of FIG. 10.

Another embodiment of the present invention is shown in FIGS. 10 and 11 and is generally designated by the numeral 60. In this form of the invention a generally circular smoke tube 62 having a hollow interior is provided with a diametrically extending tube 64. At the approximate center of the circle defined by smoke ring 62, a bowl 26D is in communication with the interior of the tube 64 through passage 30D. Projection 28 registers with the aperture 25D. A ball 24D is freely movable within the diametral section 64 and circumferential smoke tube 62. One or more tubes 16D – 16F extend upwardly from the peripheral smoke tube 62. Each of these are provided with a suitable stem or mouth piece, not shown. As has been described with reference to previous figures, the bowl 26D is loaded with appropriate tobacco or smoking material and players each draw at their respective mouth pieces at the end of respective smoke tubes 16D, 16E, 16F and 16G. The ball 24D is caused to be drawn to the smoke tube 16E – 16G of the player exerting the greatest suction.

FIG. 12 shows still another embodiment of the present invention which is generally designated by the numeral 70. In this embodiment the ball moves through a tube on the side of the pipe bowl which is not filled with smoke. For example, the embodiment shown in FIG. 12 is shown including two tobacco receiving bowls 71 and 72. From the side of each of these bowls extends a stem or mouth piece 73 through which the smoker draws smoke. A fitting 74 and 76 is removably secured to each of the bowls 71 and 72. A circuitous, symmetrical transparent tube 75 extends and is connected between opposite fittings 74 and 76. The tube 75 is secured to an appropriate base 77. A vent opening 78 is provided at the mid-point of the tube 75. When the bowls 71 and 72 are filled with tobacco and a smoker inhales at each of the mouth pieces, air is drawn into tube 75 at vent 78. The air moves along the tubes and through the pipe bowl and to the smoker's mouth. The ball 79 within tube 75 will be advanced in the direction of the smoker exerting the greatest suction force. The player is declared a winner when the ball 79 is advanced to a "home" location immediately above fitting 74 or 76 at that player's pipe bowl.

FIG. 13 shows another embodiment of the present invention generally designated by the numeral 80. This embodiment is designed primarily for use as a non-smoking pipe such as a child's bubble pipe. The device is generally constructed as the device shown in FIGS. 1 – 3. Transversely extending tube 81 on which is mounted a bowl 85. A ball 82 is free to move within the tube 81. A small check valve 82 is positioned in the bottom of pipe bowl 85 at the upper end of passageway 86. The bowl 85 is filled with an appropriate soap solution. Check valve 82 prevents water and soap solution from entering into tube 81. In use of this device, the player's blow or exhale rather than inhale. The force of the air will open check valve 82 causing air to move upwardly through bowl 85 causing bubbles to be expelled from the bowl. Simultaneously, the ball will be forced along the tube. The child moving the ball furthest through the opponent's side of the tube will be declared the winner.

Note that the present invention can be constructed from a variety of materials. However, transparent, heat-resistant, plastic materials are preferred.

FIGS. 14 and 15 illustrate a flag assembly generally indicated by the numeral 90 which can be incorporated into the tube 16 of the invention as shown in the previous embodiments. The flag assembly includes a visual marker 91 connected to actuating shaft 92 which depends at 93 into the interior 28 of tube 16 at aperture 94. As ball 24 passes, the flag assembly 90 assumes a position as shown in dotted line indicating a winner.

The various embodiments of the present invention may be easily and simply constructed and should provide interesting entertainment for the user. The device can be disassembled for easy cleaning. For example, the smoke tubes can be removed from the mouth pieces and the mouth pieces periodically flushed or cleaned as desired by the user.

It will be obvious to those skilled in the art to make various changes, alterations and modifications to the present invention. To the extent that these alterations, changes and modifications do not depart from the spirit and scope of the appended claims, they are intended to be encompassed therein.

I claim:

1. A combination game and smoking device comprising:

(a) a base;

(b) a hollow tube connected to said base and having an end;

(c) a mouthpiece associated with said end for reception in a smoker's mouth;

(d) a pipe bowl in free communication with the interior of said tube; and (e) a game piece within said tube adapted to move therein and solely in response to smoke and/or air movement in either longitudinal direction of said tube and being selected to permit passage of smoke through the tube in all positions thereof.

2. The device of claim 1 wherein said tube is transparent and is configured in an aesthetically pleasing shape.

3. The device of claim 1 wherein said tube has multiple sections each having an associated mouth piece adapted for use by multiple players.

4. The device of claim 3 wherein said tube includes a central fitting to which may be removably secured a plurality of tube sections.

5. The device of claim 1 wherein said bowl is provided with check valve means whereby said device can be used as a bubble pipe.

* * * * *